US005100186A

United States Patent [19]

Nordvall

[11] Patent Number: 5,100,186

[45] Date of Patent: Mar. 31, 1992

[54] LOCKING DEVICE

[76] Inventor: Stig H. Nordvall, Pl 780, Örsta, S-635 19 Eskilstuna, Sweden

[21] Appl. No.: 649,335

[22] Filed: Jan. 31, 1991

Related U.S. Application Data

[62] Division of Ser. No. 536,586, filed as PCT/SE89/00012, Jan. 18, 1989, abandoned.

[30] Foreign Application Priority Data

Jan. 19, 1988 [SE] Sweden ..... 8800153

[51] Int. Cl.[5] ..... E05B 15/02; E05B 47/04; E05B 47/06

[52] U.S. Cl. ..... 292/341.16; 292/144; 292/65

[58] Field of Search ..... 292/241.16, 241.15, 292/241.17, 64, 65, 144

[56] References Cited

U.S. PATENT DOCUMENTS

| | | | |
|---|---|---|---|
| 471,429 | 3/1892 | Pollard | 292/341.15 |
| 813,119 | 2/1906 | Smith | 292/341.16 |
| 1,244,910 | 10/1917 | Smith | 292/341.15 |
| 1,532,322 | 4/1925 | Lane | 292/64 |
| 2,785,916 | 3/1957 | Mutti | 292/144 |
| 3,731,963 | 5/1973 | Pond | 292/144 |
| 4,017,107 | 4/1977 | Hanchett | 292/341.16 |
| 4,302,039 | 11/1981 | Dukel et al. | 292/341.16 |

FOREIGN PATENT DOCUMENTS

| | | | |
|---|---|---|---|
| 2127089 | 4/1984 | United Kingdom | 292/341.16 |

*Primary Examiner*—Eric K. Nicholson
*Assistant Examiner*—Darnell M. Boucher
*Attorney, Agent, or Firm*—Marshall & Melhorn

[57] ABSTRACT

A locking device for locking a pin or bolt (3) in a striking plate is provided with a lock mechanism which substantially comprises a guide member (200) along which a locking slide (400) is movable. The striking plate is mounted in the rebate of a door frame (7). The guide member (200) guides the axial movement of the locking slide (400) along the striking plate.

When the door leaf (4) is being closed, the bolt (3) is inserted into the opening of the striking plate and at the same time into the corresponding recess (201) in the guide member (200). When the bolt (3) is positioned in the guide member (200), the locking slide (400) is moved to a locking position in which the locking slide encloses the bolt and prevents it from being withdrawn from the recess. The locking slide (400) is moved by an electrically operated driving means (500, 501).

10 Claims, 6 Drawing Sheets

LOCKING DEVICE

This application is a continuation of application Ser. No. 07/536,586, filed as PCT/SE89/00012, Jan. 18, 1989, abandoned Jan. 31, 1991.

The present invention relates to a locking device for a movable element which is pivotable relative to another element, and relates more precisely to a locking device of the type stated in the preamble of claim 1. The invention relates especially to a locking device for a door having a door leaf which is hung in a door frame.

Many traditional locking devices comprise a lock mounted in the door leaf and provided with one or more bolts of which at least one is operated or locked by some lock mechanism. The lock further comprises a striking plate which is formed with a hole for the bolt and which is mounted in the rebate of the frame opposite the lock. The bolts can be resilient, i.e. be kept in a projecting position by means of a spring, and are then pushed in by hand. Also non-resilient bolts can be used. In some cases, the door leaf is provided with an entirely fixed pin. What is said in this description with regard to bolts is largely applicable also to fixed pins, but for the sake of simplicity the term bolt is preferred.

There are also prior art locking devices in which the lock mechanism is not mounted in the door leaf but in the door frame. If the bolt is fixed and projects beyond the door leaf, an angular striking plate is preferably used which has an opening to allow the bolt to be inserted in the striking plate through a recess on the side of the striking plate which extends in parallel with the door leaf, and through a recess connected with said recess and formed on the side of the striking plate facing the longitudinal edge surface of the door leaf when the door is closed. When thus the door is closed and the bolt is inserted in the striking plate, a mechanism is activated which prevents the bolt from being withdrawn from the striking plate.

An example of such a locking device is to be found in U.S. Pat. No. 4,017,107 which discloses a lock mechanism having a pivotable plate which in the unlocked position is pivoted into the striking plate so as to allow insertion of the bolt. The pivotable plate requires a large pivot dimension, hereinafter called the overall dimension. This means that the lock mechanism extends deep into the frame and possibly demands a particularly thick frame. For locking, the pivotable plate is lowered and locks the bolt.

A somewhat more primitive locking device is disclosed in U.S. Pat. No. 1,244,910, in which the door leaf has a projecting bolt which is insertable in a recess in the door frame and is locked therein by means of a locking member which is vertically movable by the depression of a pedal. This locking device also requires a relatively large overall dimension, and the operating members as well as the locking members are readily damaged.

There are other types of prior art locking devices which have one lock mechanism in the door leaf and another lock mechanism in the door frame. Such locking devices are used for e.g. entrances of blocks of flats and then function such that all persons wanting to enter can unlock the lock mechanism in the door frame by activating a control member. The control member can be designed so as to allow entering at certain times only. For entering at other times, selected persons such as caretakers must be equipped with keys which match the lock mechanism in the door leaf.

Moreover, there are remote-controlled locking devices which are activated by a member for checking the authority of the person who wants to enter. The authority check can be effected by various means, for example magnetic card readers. If a card having a confirmed code is inserted into the magnetic card reader, current is supplied to the lock mechanism which may be electrically operated. The remote-controlled lock mechanism can be mounted either in the door leaf or in the door frame. When the lock mechanism is mounted in the door leaf, activating signals must be transmitted from the magnetic card reader to the lock mechanism by special means. The transmission can be implemented by e.g. flexible wires, frame terminals, electromagnetic waves etc.

However, the space for the remote-controlled lock mechanism in the door leaf is extremely limited, especially if standardised lock cases are used. It is therefore difficult to equip the lock mechanism with driving means for operating the bolt.

When the lock mechanism is mounted in the door frame, it is somewhat easier to transmit signals from a separate signal transducer for controlling the lock mechanism. One drawback when mounting the lock mechanism in the door frame is that the space is quite limited, especially in depth. Therefore, striking plates for such lock mechanisms must be small, but then another problem arises, viz. that of obtaining a sufficient degree of security from tampering.

In certain cases, one wishes to operate several doors by remote control by means of locking devices having fixed bolts projecting, say, at least 20 mm beyond the longitudinal edge surface of the door leaf, for simultaneous opening or closing of said doors. This may be desirable from a security point of view but also causes a problem. When all the doors have been locked at the same time, one may want to enter through one door only. It will then be unsuitable to open all the doors, and it is therefore desirable to have a possibility of opening or closing precisely this door by operating it on the spot. The problem in this case is that one wishes to have both remote control and control on the spot of a single lock mechanism. According to prior art technique, this is difficult to accomplish by means of a lock mechanism mounted in the door frame, since the striking plate must then have a large overall dimension.

One drawback of electrical locking devices which are mounted in the door frame is the difficulty of obtaining a sufficient degree of security, for example against burglary. It is here important that the bolt engages properly with the striking plate, which is difficult to accomplish by means of prior art devices.

A prior art locking device of this type is disclosed in DE-A-3,330,556 from which it appears both that the engagement of the locking member with the bolt is limited, and that the lock mechanism takes up a relatively large space, which in turn means that the overall dimension in the frame must be large.

U.S. Pat. No. 813,119 discloses another locking device which locks the bolt inserted in the striking plate by transverse displacement of a plate in a direction parallel to the door leaf. The plate is operated by electromagnets which can begin to vibrate in case of externally applied force, and can then lose their locking function. Also this locking device requires a relatively large overall dimension.

If heavy force is used on locking devices of the type discussed above, the lock mechanism can possibly be moved out of its locking position and then be opened. It is thus difficult to provide a lock mechanism which offers adequate resistance to damage even after it has been moved from its normal locking position.

In blocks of flats, it is not convenient, inter alia because of the risk of burglary, that the house owner/-caretaker has access to traditional type master keys. Especially for big house owners such as corporations owning local authority dwellings, it can involve heavy expense and cause great inconvenience if the master key should be lost. At the same time it is impractical to provide the caretaker with a key for each flat. A particular problem arises when repairs or similar work are to be carried out in a certain flat. Then the owner of the flat must either stay at home and wait for the workman or let a reliable person, for example the caretaker, have a spare key in advance.

The present invention aims at solving the problems and obviating the drawbacks as mentioned above. The main object of the present invention is therefore to provide a locking device which ensures a proper locking engagement of the bolt with the striking plate so as to prevent the lock from being forced open.

A further object is to facilitate remote control of the lock mechanism and/or control thereof on the spot.

A still further object is to make it possible to mount the lock mechanism in a striking plate which has a small overall dimension and can be mounted in normal frames.

One more object is to provide a blocking member for safety locking of the lock mechanism.

Finally, the invention aims at providing a lock mechanism which even outside its locking position offers a high degree of security against being forced open.

According to the invention, the above objects are achieved in that the locking device mentioned by way of introduction further has the features stated in the characterising clause of claim 1.

Further objects and advantages as well as further characteristic features of the invention are stated in the appended subclaims.

The invention will now be described in detail, reference being had to the accompanying drawings which illustrate some embodiments.

Figure 1:
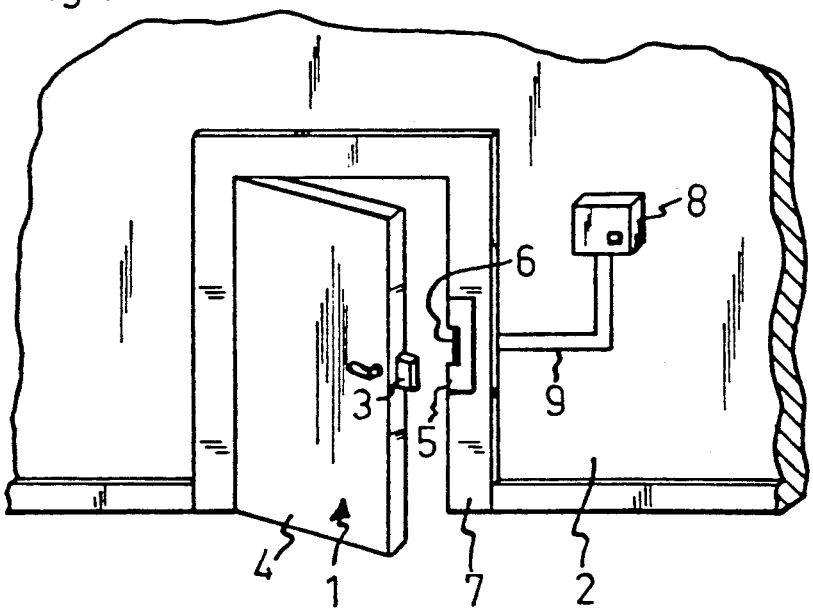
FIG. 1 is a general view of the inventive locking device in its main function, i.e. when used for a door.

As shown in FIG. 1, the locking device according to the invention is used for e.g. door 1 in a wall 2. A bolt 3 which in this embodiment is fixed, projects from the longitudinal edge surface of a door leaf 4 which is in a half-opened position. A striking plate 5 comprises a lock mechanism which is in its opened position. A recess 6 is ready to receive the bolt 3. When the door is closed, i.e. the bolt 3 is inserted in the striking plate 5 mounted on a door frame 7, the lock mechanism can be activated from a control unit 8 via signalling wires 9.

Figure 2:
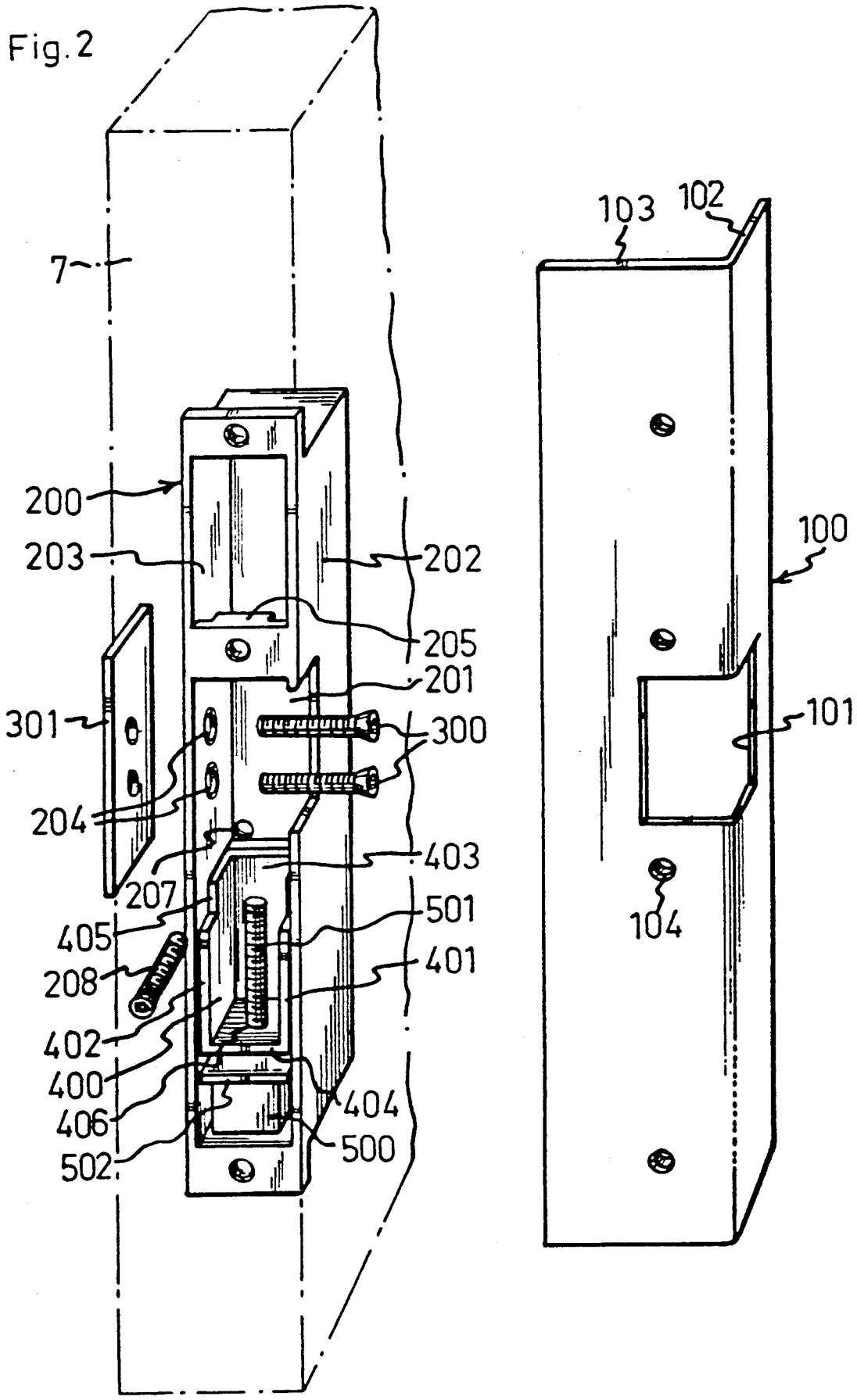
FIG. 2 shows a striking plate provided with a lock mechanism, and the associated face plate.

FIG. 2 illustrates the entire striking plate 5 which comprises a face plate 100 and a guide member 200 as well as parts associated therewith. For better clarity, the face plate 100 and the guide member 200 are separated. It will be appreciated that these two parts are assembled by means of a screw joint. The face plate 100 is the visible part of the striking plate 5 and is, according to this embodiment, L-shaped in cross-section. The face plate 100 is formed with a recess 101 which extends from the common line of two legs 102, 103 and a distance into each leg. The length and width of the recess 101 make it possible to insert a bolt 3 of a predetermined size (see FIG. 5).

The guide member 200 is formed with a recess 201 which is of the same length as the recess 101 in the face plate 100. According to a presently preferred embodiment, the guide member 200 is U-shaped in cross-section, and the recess 201 is formed in the leg 202. In the opposite leg 203, there are formed two holes 204 for insertion of two clamping screws 300. If the guide member 200 and thus the striking plate 5 are to be mounted by a special abutment in the door frame 7, a counter-plate 301 can be mounted on the opposite side of the frame 7. The two clamping screws 300 then extend through the frame 7 and clamp the guide member 200 by means of the counter-plate 301.

A locking slide 400 is mounted in the guide member 200 which together constitute the general lock mechanism. The locking slide 400 has two legs 401, 402 which are interconnected by means of a web 403 and an end wall 404. The locking slide 400 is movable along the guide member 200 to a position in which the leg 401 covers the recess 201. Further the locking slide 400 is formed with a recess 405 for a bridge 205 disposed on the guide member 200. When the locking slide 400 has taken its locking position, the recess 405 will thus engage the bridge 205, which affords security against breaking the locking device by force.

According to the embodiment preferred, the locking slide 400 is moved by means of a motor 500 which is provided with a threaded guide screw 501 extending through a threaded hole 406 in the end wall 404. When the motor 500 rotates the guide screw 501, the locking slide 400 will thus move in the longitudinal direction of the striking plate 200.

Figure 3:
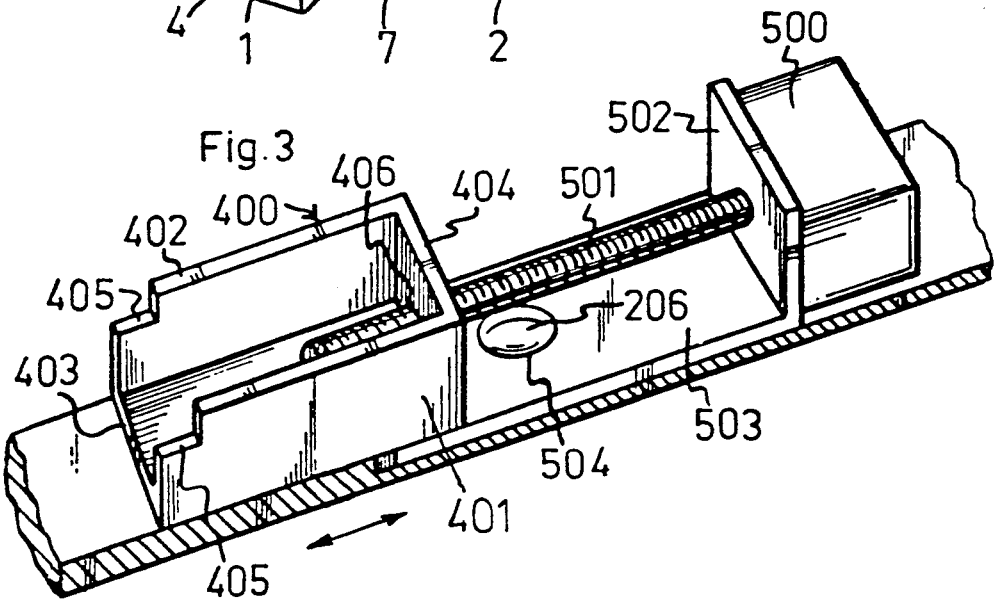
FIG. 3 is a perspective view of a locking slide and the associated driving means, some parts being broken away.

The motor 500 is mounted on a motor holding member 502 which is an L-shaped member (see FIG. 3). The motor 500 is attached to one leg through which also the guide screw 501 extends. The guide screw 501 engages the threaded hole 406 in the end wall 404 of the locking slide 400. When the guide screw 501 is rotated, the locking slide 400 is thus moved along the sliding surface which is formed of the other leg 503 of the motor holding member 502. In the leg 503, there is formed a breaking hole 504 which will be described below.

Figure 4:
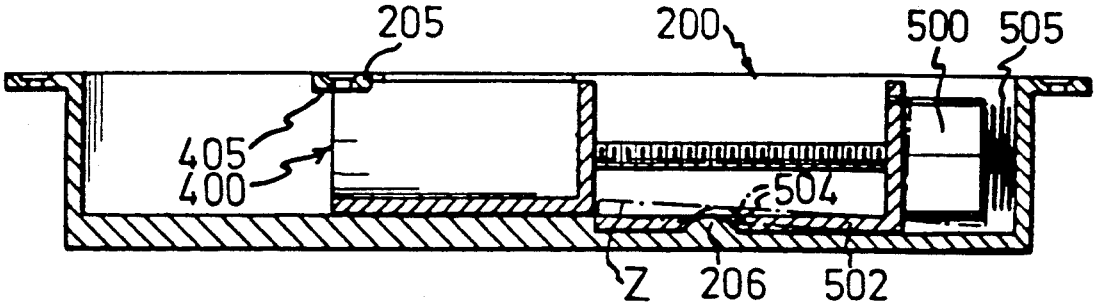
FIG. 4 is a cross-section of the lock mechanism, the locking slide being in the locking position.

FIG. 4 is a schematic cross-sectional view of the guide member 200, the locking slide 400, the motor 500 and the motor holding member 502. Besides, a spring 505 is shown which exerts a pressure upon the motor 500. This pressure is propagated to the locking slide 400 and makes the recesses 405 engage the bridge 205 in the locking position. Further, the pressing action of the spring 505 causes the breaking hole 504 to be disposed immediately above an anti-burglary member 206. In the preferred embodiment of the invention, the anti-burglary member 206 resembles a round screw head. As long as the locking slide 400 is operated normally, i.e. by means of the motor 500, the motor holding member 502 remains where it is. The anti-burglary member 206 will thus be received in the breaking hole 504.

If, on the other hand, the locking slide 400 is actuated from the outside, such as at an attempted intrusion, and is moved from its locking position, the situation will change. The locking slide 400 can then be moved slightly out of its locking position, but not so far that it loses its action of locking the bolt 3. When the locking slide 400 is moved in this manner, the entire motor holding member 502 will be moved at the same time. Since the motor holding member 502 has now been moved, the breaking hole 504 leaves the anti-burglary member 206, and the entire motor holding member 502 is dislodged from its normal position in the guide member 200. The dislodged position of the motor holding member 502 is shown by a dashed line at Z. Then all the components of the lock mechanism will extend at incorrect angles relative to each other, which means that the lock mechanism is eliminated and can no longer be actuated.

If somebody thus tries to intrude by breaking the lock mechanism by force, the result will be the opposite. Even after such an attempt, the locking slide 400 will maintain its action of locking the bolt 3.

Figure 5:
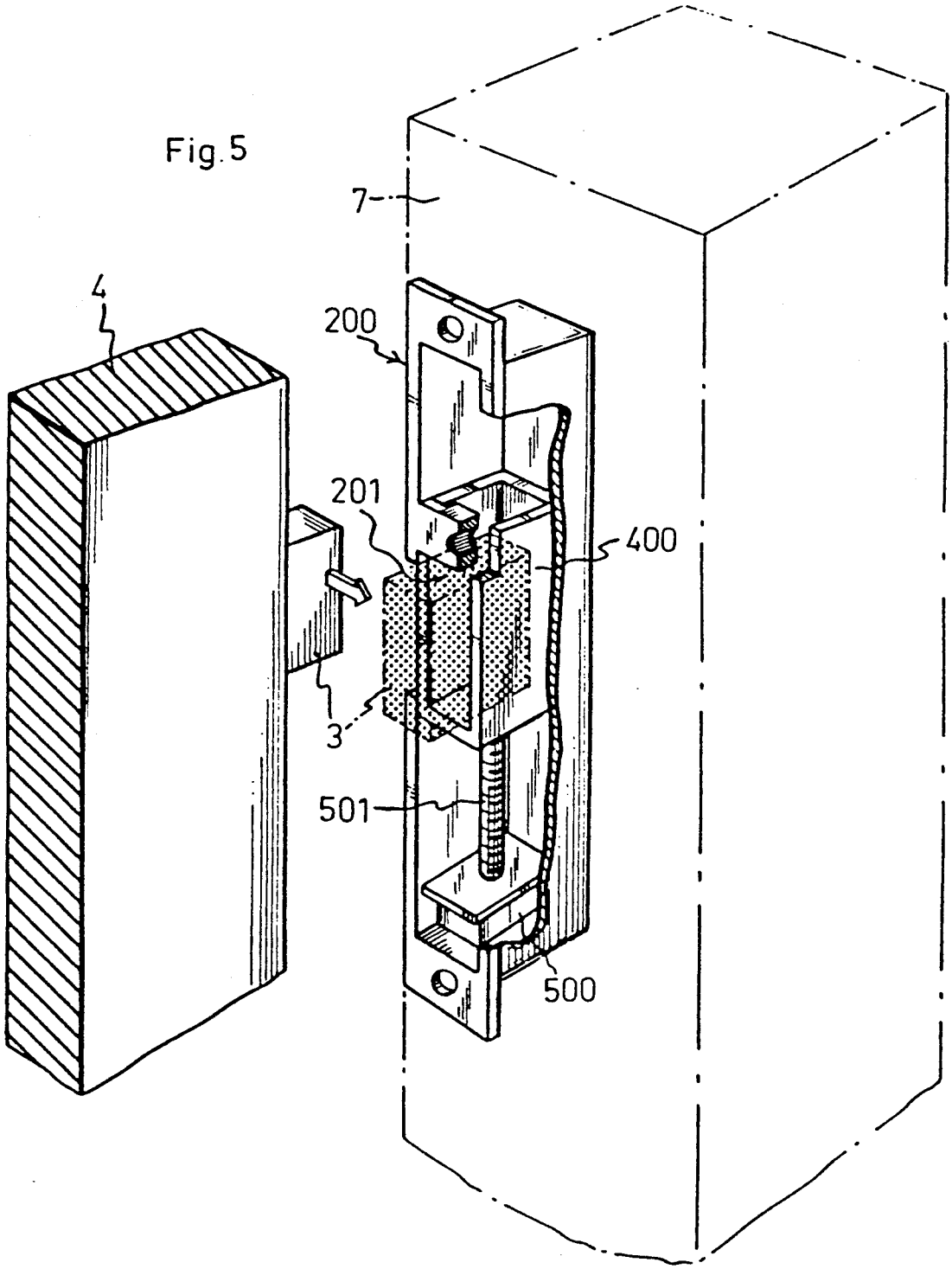
FIG. 5 shows schematically the coaction between a bolt and the lock mechanism, the locking slide being in the locking position.

FIG. 5 which, for better clarity, shows the closing operation from the opposite direction as compared to FIG. 1, illustrates how the bolt 3 coacts with the locking slide 400. The door leaf 4 is moved in the direction of the arrow until the bolt 3 is inserted in the recess 201 of the guide member 200. Subsequently, the locking slide 400 is displaced by means of the motor 500 and the guide screw 501 to the locking position in which the bolt 3 is enclosed. This position of the bolt 3 is marked by dots.

Now reference is again made to FIG. 2. In some cases, it is desirable to block the lock mechanism in a certain position, for example the locking position. To this end, a hole 207 for receiving a pin 208 is formed in the web 209 of the guide member 200. The pin 208 can be inserted through a hole 104 in the face plate 100 and be caused to engage the hole 207, whereupon the locking slide 400 is blocked efficiently.

Such a blocking member eliminates the drawbacks of master keys. A flat owner normally actuates a lock mechanism mounted in the door leaf, for which only the flat owner has got the keys. A lock mechanism according to the present invention is mounted in the striking plate. The actuating means in the lock mechanism can be a normal cylinder which must be rotated several times to enable the guide screw to move the locking slide. According to the preferred embodiment, the driving means is an electric motor. The essential thing is that the caretaker can operate the actuating means. As long as the flat owner uses the door in a normal manner, the locking slide is in the locking position and the pin is in its blocking position. When this is the case, the door can be opened merely by means of the lock mechanism mounted in the door leaf.

When the caretaker needs access to the flat, the tenant simply removes the pin that day. Then the caretaker can actuate the lock mechanism in the striking plate and enter the flat.

Figure 6:
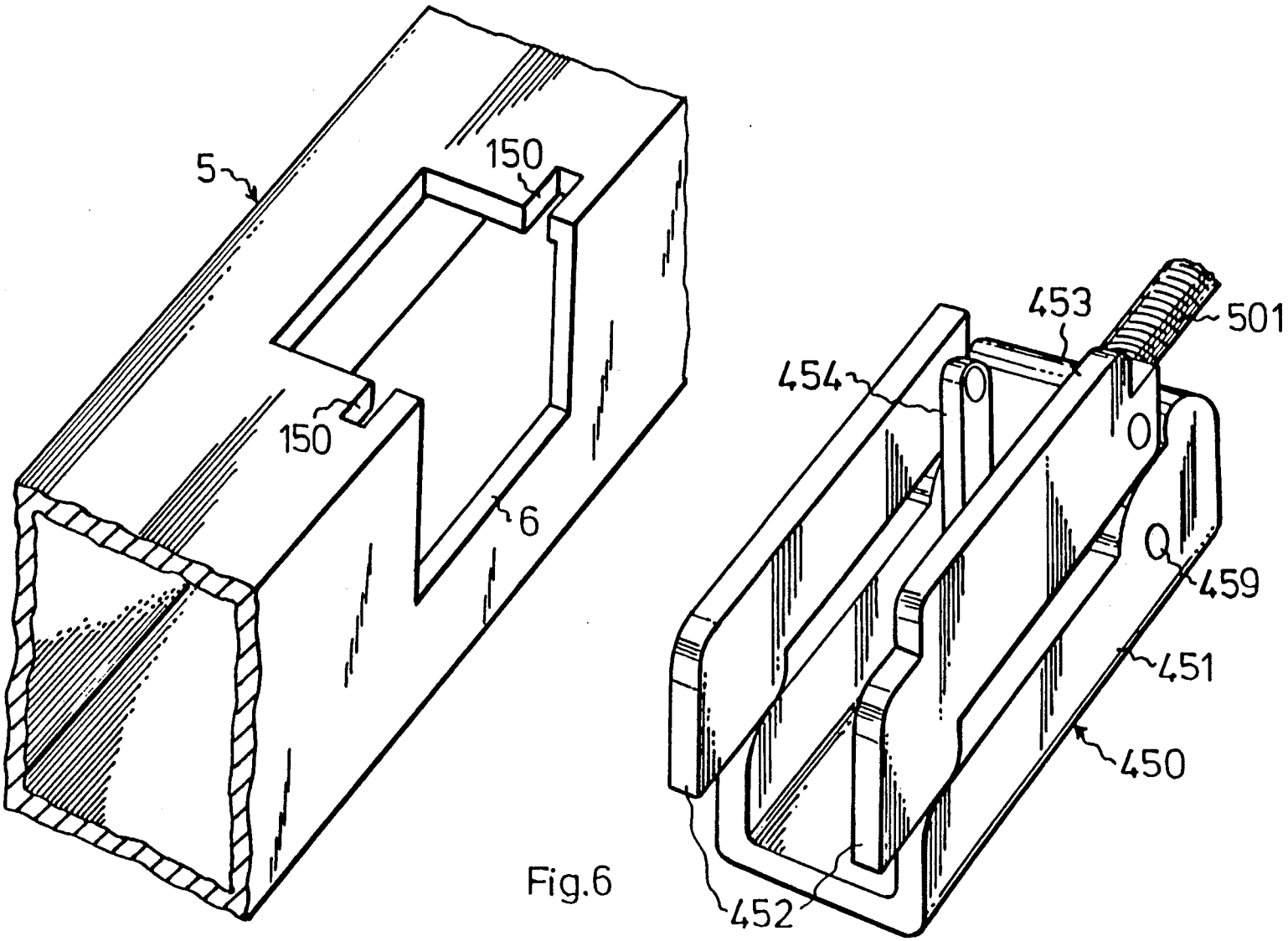
FIG. 6 is a perspective view of a variant of the locking slide and the associated striking plate, the two parts being separated.

FIG. 6 shows a differently designed locking slide 450 consisting of two members, viz. a first member 451 connected with the guide screw 501, and a second member 452 which is formed with an elongate projection 453 for engaging two grooves 150 connecting with the recess 6 of the striking plate 5. The two members 451, 452 of the locking slide 450 are connected with each other by means of a U-shaped link means 454.

Figure 8:
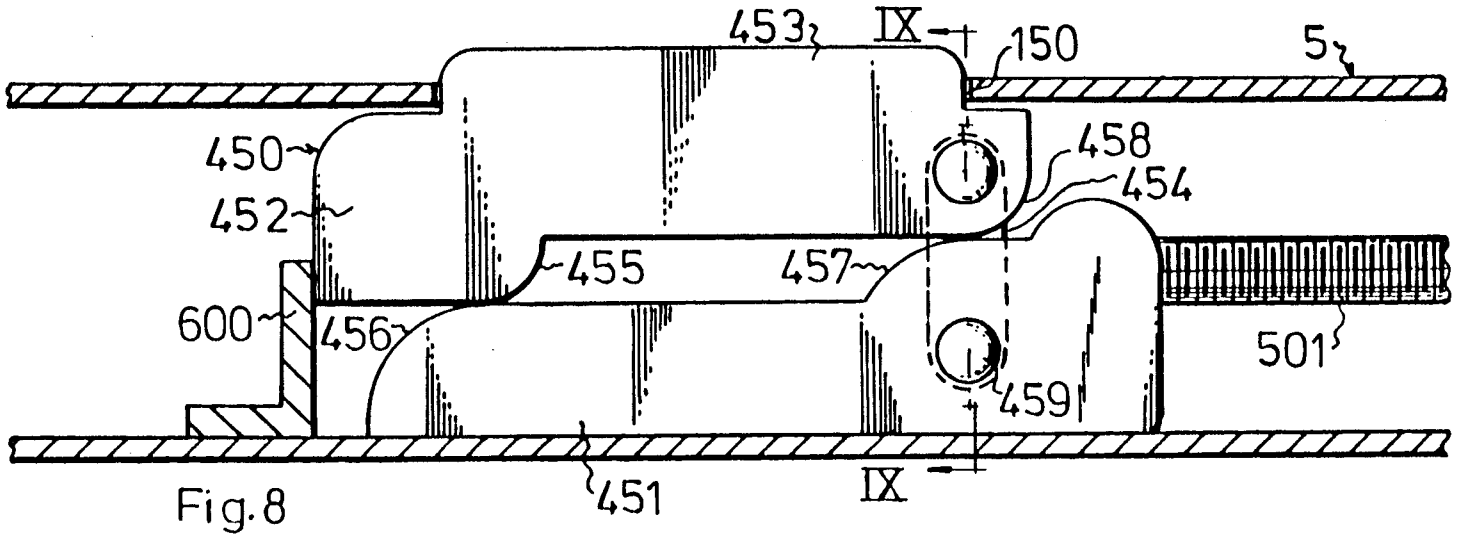
FIG. 8 shows the locking slide in its locking position.
Figure 7:
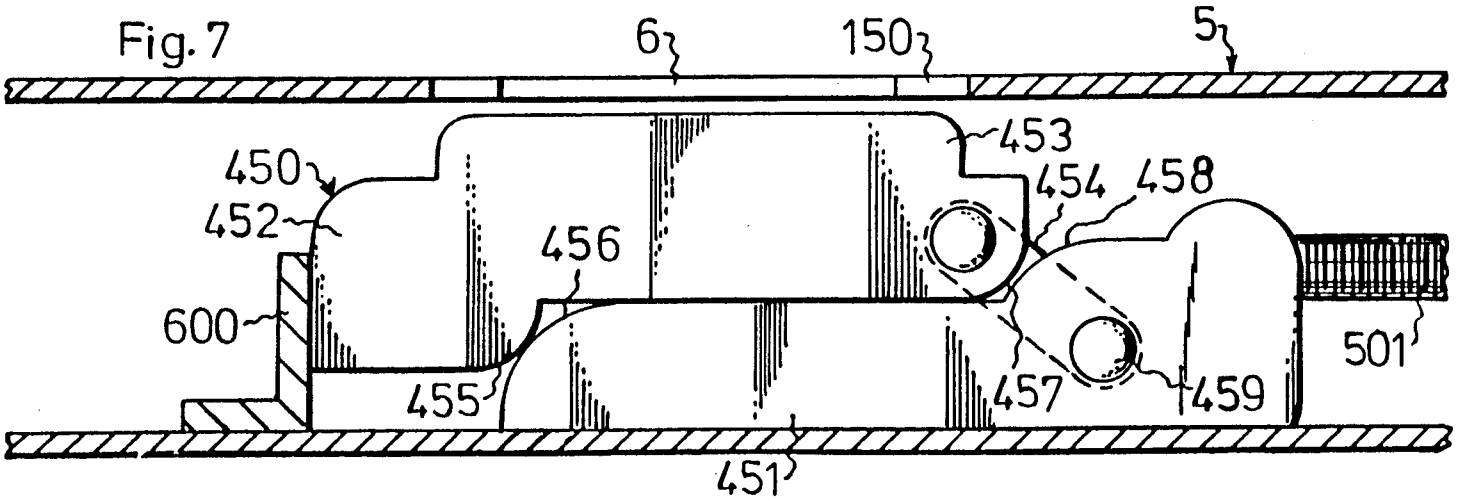
FIG. 7 shows the locking slide in FIG. 6 positioned inside the striking plate and engaging a dog means.

The locking function of the two-piece locking slide 450 is shown in FIGS. 7 and 8. The locking slide 450 is moved just like before by rotation of the guide screw 501. In the locking position, the second member 452 of the locking slide 450 will first engage with a fixed dog means 600 formed on the striking plate 5, whereupon, when the guide screw 501 is rotated further, the member 452 is caused to move in a direction at right angles to the moving direction of the locking slide 450 in the striking plate 5. The movement of the second member 452 is effected by the link means 454 and by cams 455, 456 and, respectively, 457, 458 formed on the two members 451 and 452 of the locking slide 450 and coacting with each other. It will be appreciated that the locking slide 450 will be most safely locked in the final locking position as shown in FIG. 8, due to the engagement of the elongate projection 453 with the grooves 150 (see also FIG. 6). Through this design, a most burglar-proof locking of the locking slide 450 is obtained in the locking position.

Figure 9:
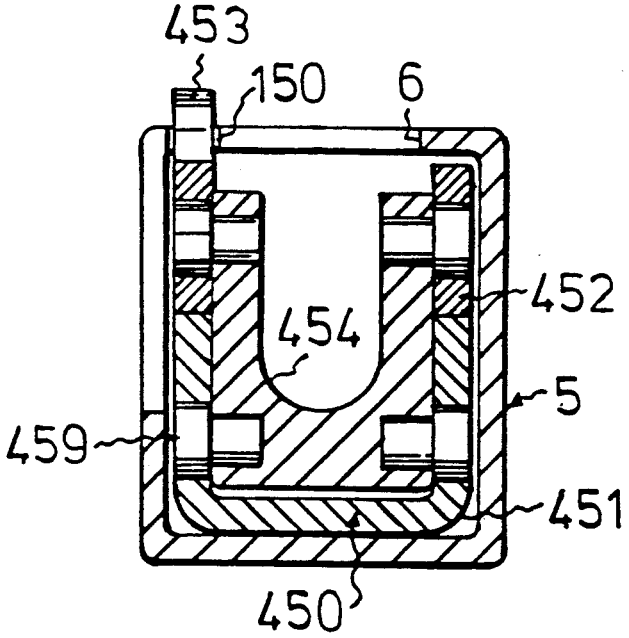
FIG. 9 is a cross-section along line IX—IX in FIG. 8.

FIG. 9 is a cross-section of the striking plate 5 and the locking slide 450 positioned therein. The link means 454 is hingedly connected with the two members 451, 452 of the locking slide 450 by means of four guide pins 459. The size of the locking slide 450 is accurately adapted to the space inside the striking plate 5 and with regard to the necessary clearance. According to another embodiment (not shown), a plate of hardened steel is attached to the outside of the locking slide leg which includes the projection 453. The hardened plate which is disposed between the inner wall of the striking plate 5 and said leg, makes the locking device even more burglar-proof.

To sum up, it can be established that the present invention solves the problems mentioned above and obviates the above drawbacks of prior art. The following advantages are achieved.

The lock mechanism mainly operates axially in the striking plate 200, i.e. in the longitudinal direction of the door frame 7, whereby the overall dimension, i.e. the depth to which the locking device extends in the frame, will be largely the same as for a normal striking plate, say, about 20–30 mm.

Substantially the entire overall dimension can be used to take up the bolt, whereby an excellent engagement of the bolt with the locking slide and thus satisfactory resistance to breaking open are obtained. If the two-piece locking slide 450 is used, the locking device is made even more burglar-proof.

The driving means can be accomplished in various ways, such as by electric motors, piston-and-cylinder assemblies etc., or by combining different driving means. The locking device can therefore be operated both by remote control and on the spot.

The present invention relates to a locking device for general applications. The striking plate provided with the lock mechanism can thus be mounted in doors, gates, barriers, shutters etc. Furthermore, several locking devices can be mounted in the same door and need not even be mounted in the door frame. The material and dimensions of the locking device may be varied as required.

It should finally be pointed out that the invention is in no way restricted to the embodiments described above, but various modifications are conceivable within the scope of the inventive idea as defined in the appended claims.

The motor 500 can also be completely fixedly mounted, in which case other means are used to increase the resistance to breaking open, for example the two-piece locking slide 450 and the associated projection 453 which locks the slide.

It should further be mentioned that the linear displacement of the locking slide in the striking plate can be accomplished in a different manner. The motor and the guide screw can be replaced by, for example, a pneumatically or hydraulically operated piston-and-cylinder assembly or the like. The important thing is that the locking slide is movable in the striking plate between two positions, viz. a first unlocked position in which the bolt is insertable in the recess, and a second position in which the locking slide encloses and locks the bolt, such that the bolt cannot be withdrawn from the striking plate.

I claim:

1. A locking device comprising:

a) a locking slide including at least two members, each member having a cooperating facing camming surface thereon;

b) means pivotally interconnecting the members of said locking slide; and c) means for driving said locking slide along a first path between a locked and an unlocked position;

whereby as said locking slide is driven along said first path, the cooperating facing camming surfaces of the members of said locking slide cause at least one of the members to move in a second path from a locked position to a further secured position.

2. The invention defined in claim 1 wherein the second path is substantially normal to the first path.

3. The invention defined in claim 1 including means for guiding said locking slide along the first path.

4. The invention defined in claim 3 wherein said means for guiding includes a U-shaped channel.

5. The invention defined in claim 1 wherein said means for driving said locking slide includes a motor driven guide screw.

6. The invention defined in claim 3 wherein one of the members of said locking slide includes a projection.

7. The invention defined in claim 6 wherein said means for guiding further includes a slot for receiving the projection of one of the members of said locking slide.

8. A locking device for locking two relatively movable elements, comprising:

a) a striking plate affixed to one of the elements, said striking plate having a recess for receiving a bolt means affixed to the other one of the elements;

b) a guide member c) a locking slide including at least a first and a second member, each member having a cooperating facing camming surface thereon, and said locking slide being movable within said guide member; and d) means for driving said locking slide along a first path between a locked position and an unlocked position;

whereby as said locking slide is driven along the first path, the cooperating facing camming surfaces of the members of said locking slide cause at least one of the members to move in a second path normal to the first path.

9. The invention defined in claim 8 wherein the means for driving said locking slide includes a motor driven guide screw.

10. The invention defined in claim 1, wherein said pivotally interconnecting means is a linkage means.

* * * * *